US009011165B2

(12) United States Patent
Liu et al.

(10) Patent No.: US 9,011,165 B2
(45) Date of Patent: Apr. 21, 2015

(54) POWER ADAPTER

(71) Applicant: Wistron Corporation, New Taipei (TW)

(72) Inventors: Wei-wei Liu, New Taipei (TW); Chun-Ming Lin, New Taipei (TW)

(73) Assignee: Wistron Corporation, Hsichih, New Taipei (TW)

( * ) Notice: Subject to any disclaimer, the term of this patent is extended or adjusted under 35 U.S.C. 154(b) by 88 days.

(21) Appl. No.: 14/047,035

(22) Filed: Oct. 7, 2013

(65) Prior Publication Data

US 2014/0199871 A1 Jul. 17, 2014

(30) Foreign Application Priority Data

Jan. 14, 2013 (CN) ..... 2013 1 0012895

(51) Int. Cl.
*H01R 13/44* (2006.01)
*H01R 31/06* (2006.01)

(52) U.S. Cl.
CPC ..... *H01R 31/065* (2013.01); *H01R 13/44* (2013.01)

(58) Field of Classification Search
CPC ..... H01R 35/04
USPC ..... 439/131
See application file for complete search history.

(56) References Cited

U.S. PATENT DOCUMENTS

| | | | | |
|---|---|---|---|---|
| 7,484,972 | B1 * | 2/2009 | Kuo et al. | 439/131 |
| 2002/0090848 | A1 * | 7/2002 | Yu | 439/131 |
| 2007/0155202 | A1 * | 7/2007 | Chuang | 439/131 |
| 2012/0322281 | A1 * | 12/2012 | Chou et al. | 439/131 |

* cited by examiner

*Primary Examiner* — Phuong Dinh
(74) *Attorney, Agent, or Firm* — Winston Hsu; Scott Margo

(57) ABSTRACT

A power adapter includes a casing, a first connector, a rotary mechanism and a second connector. The first connector is rotatably disposed on a bottom of the casing. A first opening and a second opening are formed on the casing. The rotary mechanism is disposed between the casing and the first connector. The second connector is movably disposed inside the casing and connected to the rotary mechanism. The second connector is electrically connected to the first connector. An external plug inserts into the seconding opening to connect the second connector. The second connector is pushed by the external plug to drive the rotary mechanism to rotate the first connector, and a part of the first connector protrudes from an inner of the casing via the first opening.

17 Claims, 13 Drawing Sheets

POWER ADAPTER

BACKGROUND OF THE INVENTION

1. Field of the Invention

The present invention relates to a power adapter, and more particularly, to an automatically adjustable power adapter.

2. Description of the Prior Art

With the advanced technology, the portable electronic device can directly charge the inner battery in place of exchanging the battery for extension of the usage time. Generally, a battery charger includes a voltage transformer component and two connectors. The connectors are the USB connector and the conventional multi-sheet connector, and the voltage transformer component is connected between the connectors. The USB connector is disposed on a casing of the battery charger as a sunken structure. The conventional multi-sheet connector is rotatably disposed inside the casing, and can be moved out of the casing to insert into the socket for charging or be moved into the casing for collection. However, the multi-sheet connector of the conventional battery charger is rotated manually according to user's demand, so that modes of the conventional battery charger may be difficultly switched due to insufficient force or damage of rotary mechanism. Thus, design of a power adapter capable of conveniently controlling the rotary angle of the multi-sheet connector is an important issue in the related mechanical industry.

SUMMARY OF THE INVENTION

The present invention provides an automatically adjustable power adapter for solving above drawbacks.

According to the claimed invention, a power adapter includes a casing, a first connector, a rotary mechanism and a second connector. A first opening and a second opening are formed on the casing. The first connector is rotatably disposed on a bottom of the casing. The rotary mechanism is disposed between the casing and the first connector. The second connector is movably disposed inside the casing and connected to the rotary mechanism. The second connector is electrically connected to the first connector. The second connector is pushed by an external plug when the external plug inserts into the second opening to connect the second connector, so as to drive the rotary mechanism to rotate the first connector and to protrude a part of the first connector from the casing via the first opening.

According to the claimed invention, the first connector is a multi-sheet plug, and the second connector is a universal serial bus socket.

According to the claimed invention, the power adapter further includes a resilient component disposed on the rotary mechanism. The resilient component drives the rotary mechanism to rotate the first connector into the casing.

According to the claimed invention, the rotary mechanism includes a shaft and an actuating component. The shaft pivots to the casing. The actuating component and the first connector are disposed on the shaft. The second connector is slidably connected to the actuating component.

According to the claimed invention, an inclined portion is disposed on an end of the actuating component, and the second connector slides relative to the inclined portion to rotate the shaft.

According to the claimed invention, a structural direction of the actuating component is substantially parallel to a structural direction of the first connector, and the inclined portion is a polygon structure.

According to the claimed invention, the rotary mechanism includes a gear axle and a rack structure. The gear axle pivots to the casing, the first connector is disposed on the gear axle, and the rack structure is engaged with the gear axle and connected to the second connector.

According to the claimed invention, the second connector pushes the rack structure to revolve the gear axle by engagement.

According to the claimed invention, a moving distance of the rack structure relative to the gear axle is substantially equal to a one-fourth outer diameter of the gear axle.

According to the claimed invention, the rotary mechanism includes a shaft and a linkage set. The shaft pivots to the casing, the first connector is disposed on the shaft, and two ends of the linkage set are respectively connected to the shaft and the second connector.

According to the claimed invention, the linkage set includes a first bar and a second bar. The first bar is disposed on a surface of the shaft, and the second bar is rotatably connected between the second connector and the first bar.

According to the claimed invention, the second bar is a straight bar or a curved bar.

According to the claimed invention, the rotary mechanism includes a shaft and a board. The shaft pivots to the casing, the first connector and the board are respectively disposed on different arc surfaces of the shaft, and the second connector pushes the board to rotate the shaft.

According to the claimed invention, a planar normal vector of the board is substantially parallel to a structural direction of the first connector.

According to the claimed invention, the rotary mechanism includes a shaft, an actuating component and a guiding component. The shaft pivots to the casing, and the actuating component is connected to the shaft and movably disposed inside the guiding component.

According to the claimed invention, a guiding slot is formed on the guiding component, and the guiding slot is an arc slot.

According to the claimed invention, the guiding component includes a guiding arc portion, and the guiding arc portion is a semicircle sunken structure.

The power adapter of the present invention can automatically eject the first connector from the casing due to connection of the external plug. As the external plug is connected to the second connector of the power adapter, the second connector slidably disposed inside the casing can be pressed by the external plug and generate a slight movement, so as to rotate the rotary mechanism such as the above-mentioned embodiments for protruding the first connector from the casing. After the external plug is removed from the power adapter, the rotary mechanism can recover the first connector and the second connector back to the initial state by the resilient component.

Therefore, the power adapter of the present invention has the automatically adjustable function. Comparing to the prior art, the power adapter of the present invention has advantages of simple structure, low manufacturing cost and easy operation. The power adapter of the present invention can stretch and retract the movable connector automatically according to assembly and disassembly of the external plug, and can effectively overcome the inconveniently operational drawback of the conventional adapter.

These and other objectives of the present invention will no doubt become obvious to those of ordinary skill in the art after reading the following detailed description of the preferred embodiment that is illustrated in the various figures and drawings.

DETAILED DESCRIPTION

Figure 1:
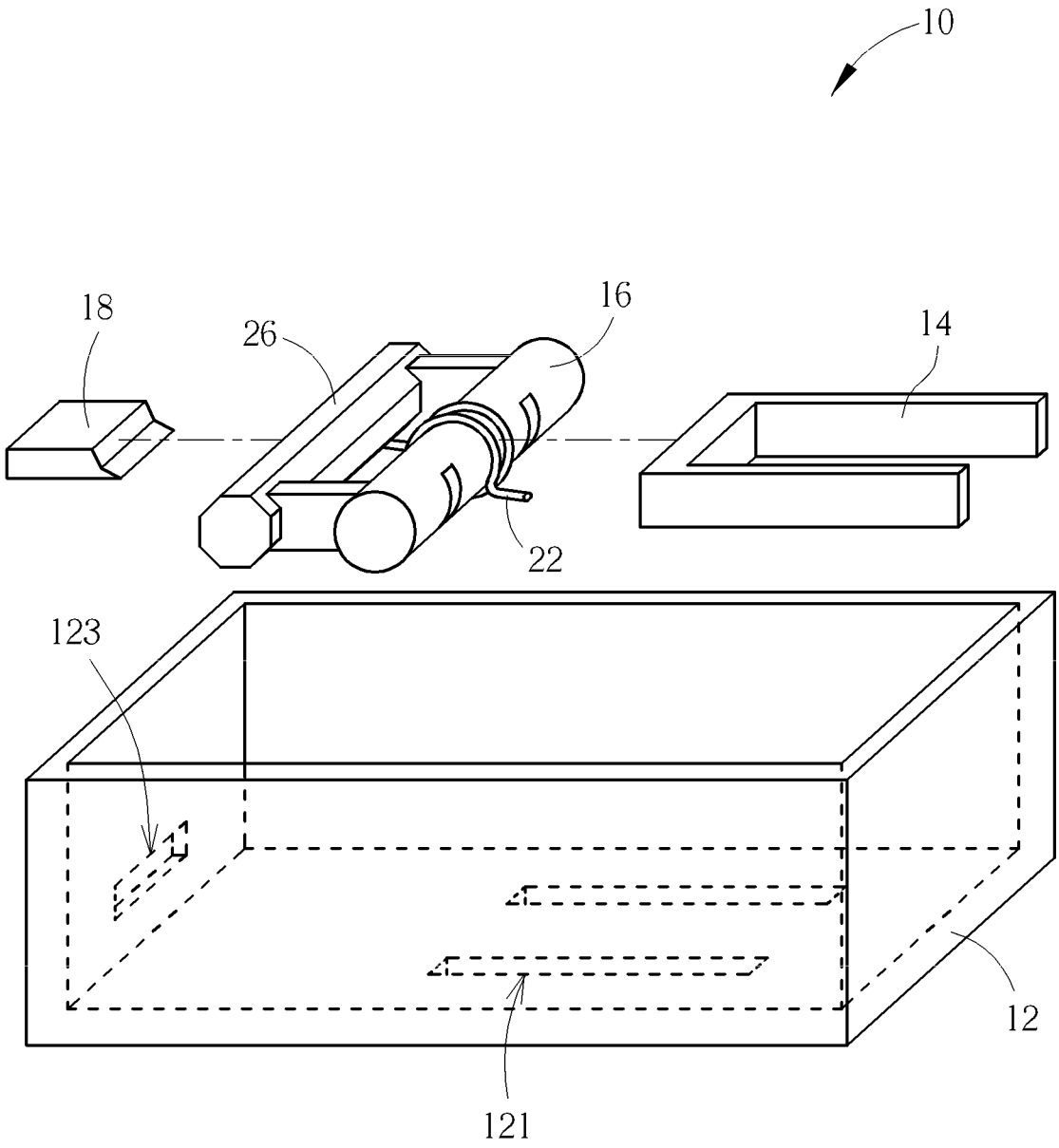
FIG. 1 is an exploded diagram of a power adapter according to a first embodiment of the present invention.
Figure 2:
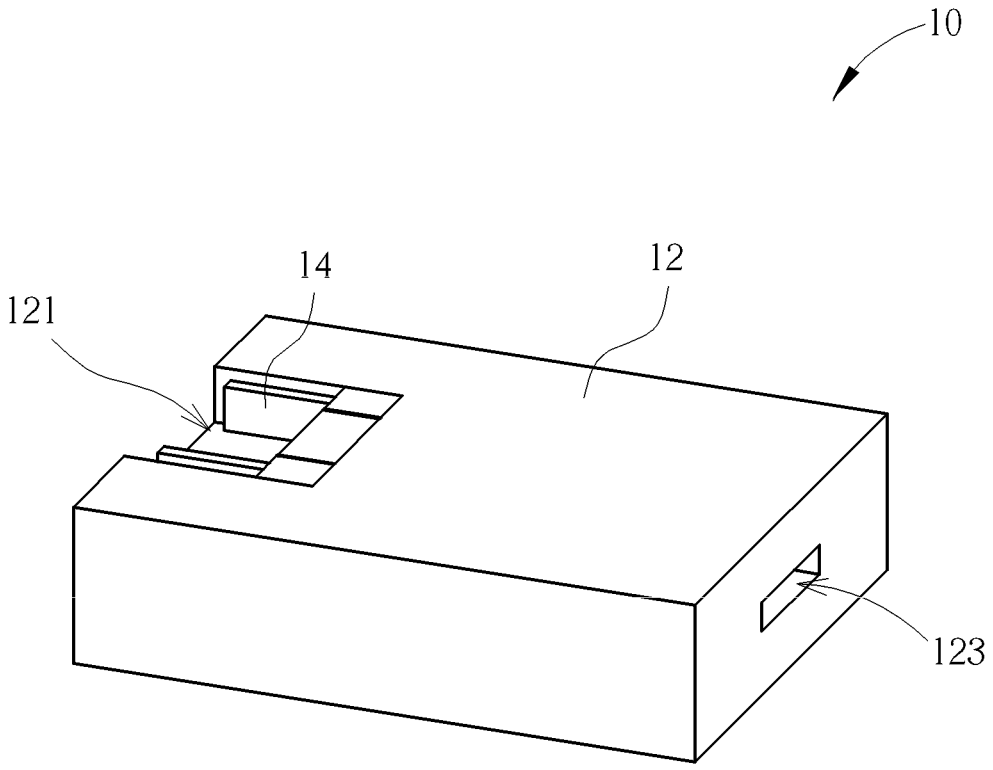
FIG. 2 and FIG. 3 respectively are diagrams of the power adapter in different operation modes according to the first embodiment of the present invention.
Figure 3:
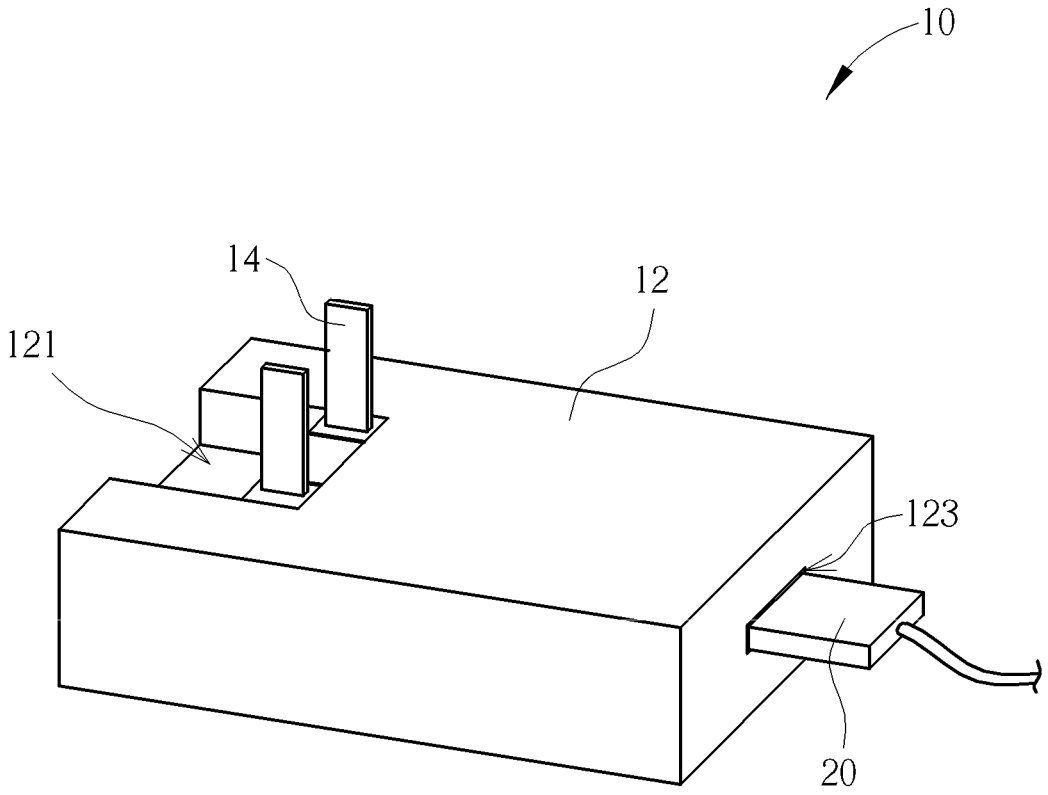

Please refer to FIG. 1 to FIG. 3. FIG. 1 is an exploded diagram of a power adapter 10 according to a first embodiment of the present invention. FIG. 2 and FIG. 3 respectively are diagrams of the power adapter 10 in different operation modes according to the first embodiment of the present invention. The power adapter 10 includes a casing 12, a first connector 14, a rotary mechanism 16 and a second connector 18. The casing 12 can cover components of the power adapter 10 for protection and artistic appearance. A first opening 121 and a second opening 123 are formed on the casing 12. The rotary mechanism 16 can move the first connector 14 out of the first opening 121.

An external plug 20 can insert into the casing 12 via the second opening 123 to connect the second connector 18. The first connector 14 is rotatably disposed on a bottom of the casing 12, the second connector 18 is movably disposed inside the casing 12, and the first connector 14 is electrically connected to the second connector 18. The rotary mechanism 16 pivots to the casing 12, the first connector 14 and the second connector 18 are connected to the rotary mechanism 16, so that the external plug 20 can connect and push the second connector 18 to rotate the first connector 14 via the rotary mechanism 16.

Generally, the first connector 14 can be a multi-sheet plug, such as the two-sheet plug and the three-sheet plug. The second connector 18 can be a universal serial bus (USB) socket 18. The external plug 20 with USB interface can insert into the power adapter 10 of the present invention when intending to electrically connect the 110 voltage socket (or the 220 voltage socket), so as to transform transmission voltage for the conventional socket. As shown in FIG. 2, the first connector 14 is accommodated inside the first opening 121 on the casing 12 when the power adapter 10 is not in use. As shown in FIG. 3, the external plug 20 can insert into the second connector 18 via the second opening 123, and the second connector 18 is pushed to drive the rotary mechanism 16 to rotate the first connector 14, so as to protrude a part of the first connector 14 from the casing 12 through the first opening 121.

In addition, the power adapter 10 can further include a resilient component 22 disposed on the rotary mechanism 16. As the external plug 20 is removed from the second opening 123, the second connector 18 is not pressed, and the resilient component 22 can drive the rotary mechanism 16 to reversely rotate the first connector 14, so as to move the first connector 14 into the casing 12.

Figure 4:
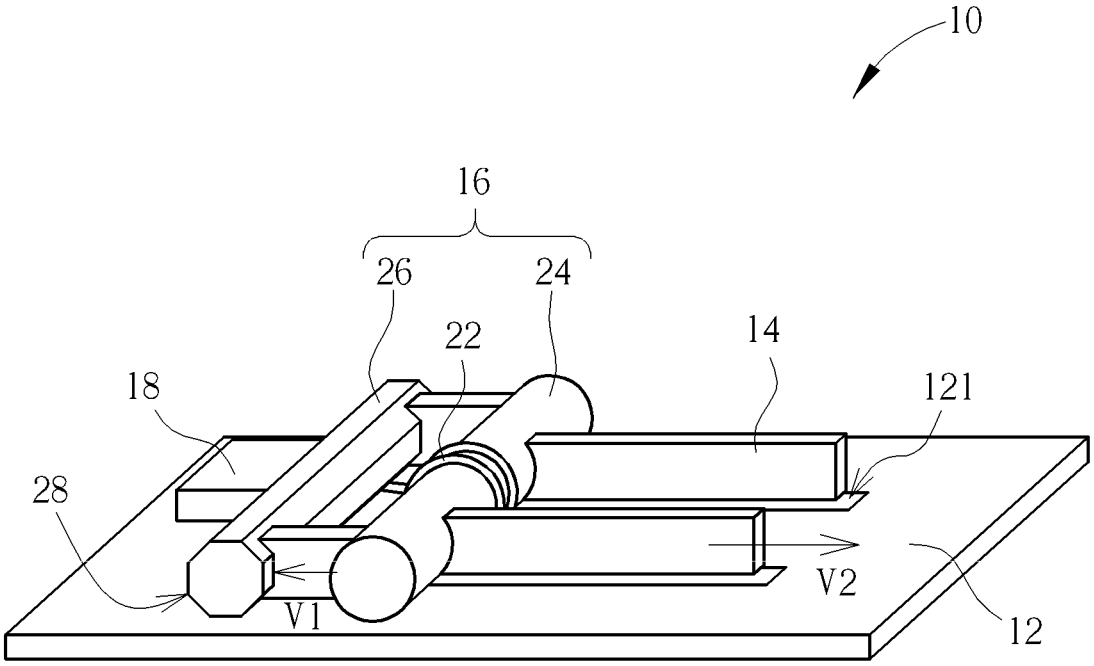
FIG. 4 and FIG. 5 respectively are diagrams of the partial structure shown in FIG. 2 and FIG. 3.
Figure 5:
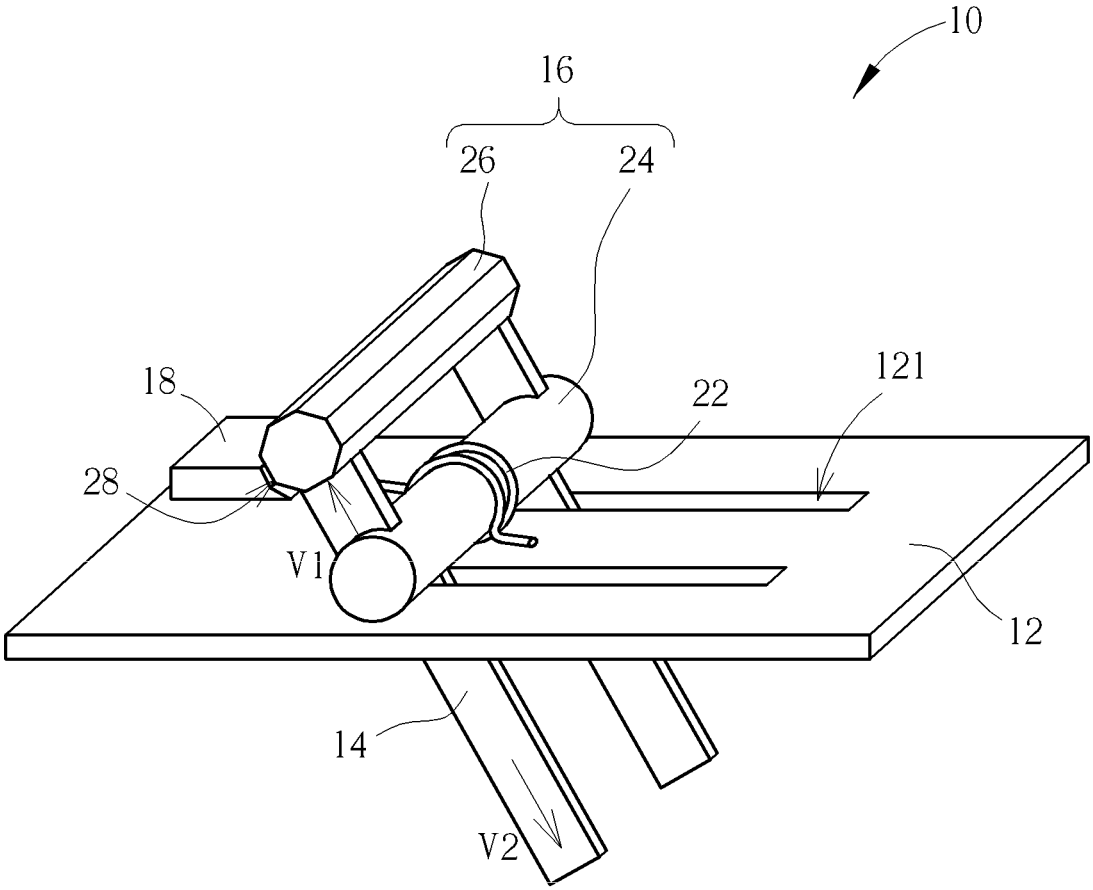

Please refer to FIG. 4 and FIG. 5. FIG. 4 and FIG. 5 respectively are diagrams of the partial structure shown in FIG. 2 and FIG. 3. The rotary mechanism 16 can include a shaft 24 and an actuating component 26. The shaft 24 pivots to the bottom of the casing 12. The actuating component 26 and the first connector 14 are respectively disposed on different positions of the shaft 24. The second connector 18 is slidably connected to the actuating component 26. As shown in FIG. 4, the second connector 18 is located at an initial position, the external plug 20 does not insert into the second connector 18, and the first connector 14 is accommodated inside the casing 12. As shown in FIG. 5, an inclined portion 28 can be disposed on an end of the actuating component 26 adjacent to the second connector 18. The inclined portion 28 can be a polygon structure, which contacts against an edge of the second connector 18.

When the external plug 20 inserts into the second connector 18 and moves the second connector 18, an end of the second connector 18 can be the inclined block, and the inclined block can push the inclined portion 28 of the actuating component 26. The inclined portion 28 can be ascended (or reversely descended), so that the actuating component 26 can rotate the shaft 24 simultaneously. The rotary mechanism 16 may be blocked when the shaft 24 rotates at the predetermined angle, such as 90 degrees, and the part of the first connector 14 protrudes from the casing 12 for connection with the conventional socket.

Therefore, the power adapter 10 of the present invention can simultaneously move the first connector 14 out of the casing 12 when the external plug 20 inserts into the power adapter 10, and further can utilize the resilient recovering force of the resilient component 22 (such as the torsional spring) to move the first connector 14 into the casing 12 when the external plug 20 is removed from the power adapter 10, so as to achieve automatic stretchable/retractable function. Besides, a structural direction V1 of the actuating component 16 can be substantially parallel to a structural direction V2 of the first connector 14 to effectively decrease volume thickness of the power adapter 10.

Figure 6:
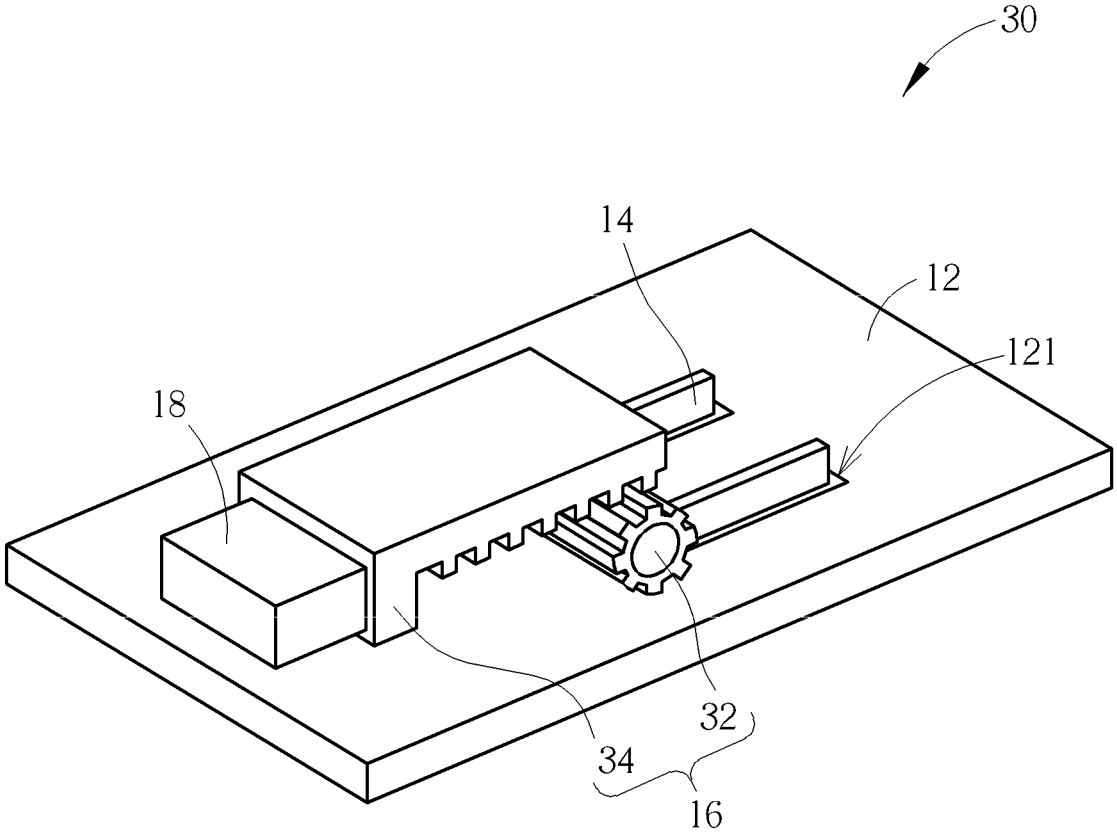
FIG. 6 and FIG. 7 respectively are diagrams of the power adapter in different operation modes according to a second embodiment of the present invention.
Figure 7:
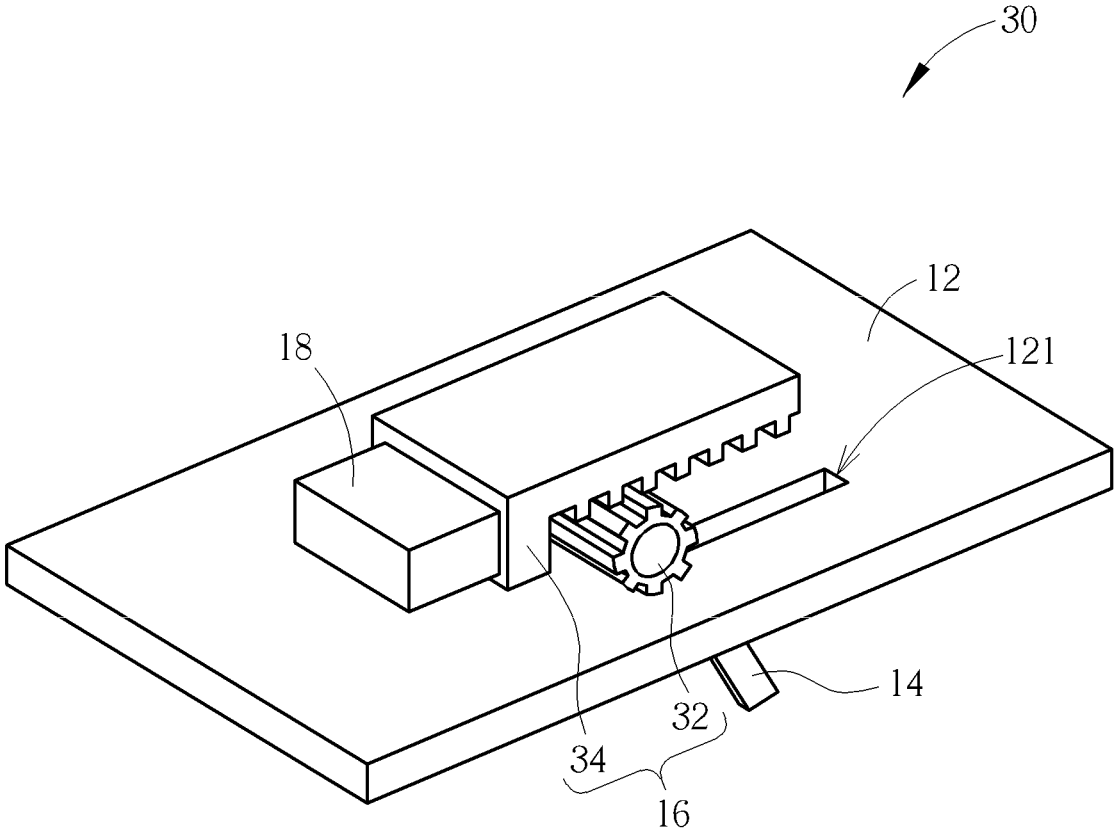

Please refer to FIG. 6 and FIG. 7. FIG. 6 and FIG. 7 respectively are diagrams of the power adapter 30 in different operation modes according to a second embodiment of the present invention. In the second embodiment, elements having the same numeral as ones of the first embodiment have the same structures and functions, and detailed description is omitted herein for simplicity. The rotary mechanism 16 further can include a gear axle 32 and a rack structure 34. The gear axle 32 pivots to the casing 12. The first connector 14 is disposed on the gear axle 32 and moves according to rotation of the gear axle 32. The rack structure 34 is engaged with the gear axle 32 and connected to the second connector 18. The rack structure 34 can be a board which moves at the direction parallel to the bottom of the casing 12.

As shown in FIG. 6, a front edge of the rack structure 34 is engaged with the gear axle 32, and meanwhile the first connector 14 is accommodated inside the casing 12. As shown in FIG. 7, the second connector 18 can push the rack structure 34 to simultaneously revolve the gear axle 32 when the external plug 20 inserts into the casing 12 and connects to the second connector 18. With rotation of the gear axle 32, the part of the first connector 14 can move out of the casing 12, and the power adapter 30 is switched to the used mode. A moving distance of the rack structure 34 relative to the gear axle 32 can be substantially equal to a one-fourth outer diameter of the gear axle 32, which means the outer diameter of the gear axle 32 is substantially four times the moving distance of the rack structure 34 relative to the gear axle 32, so that the rack structure 34 can rotate the gear axle 32 at 90 degrees no matter what position the rack structure 34 is engaged with the gear axle 32, and the first connector 14 can perpendicularly protrude from the casing 12.

Figure 8:
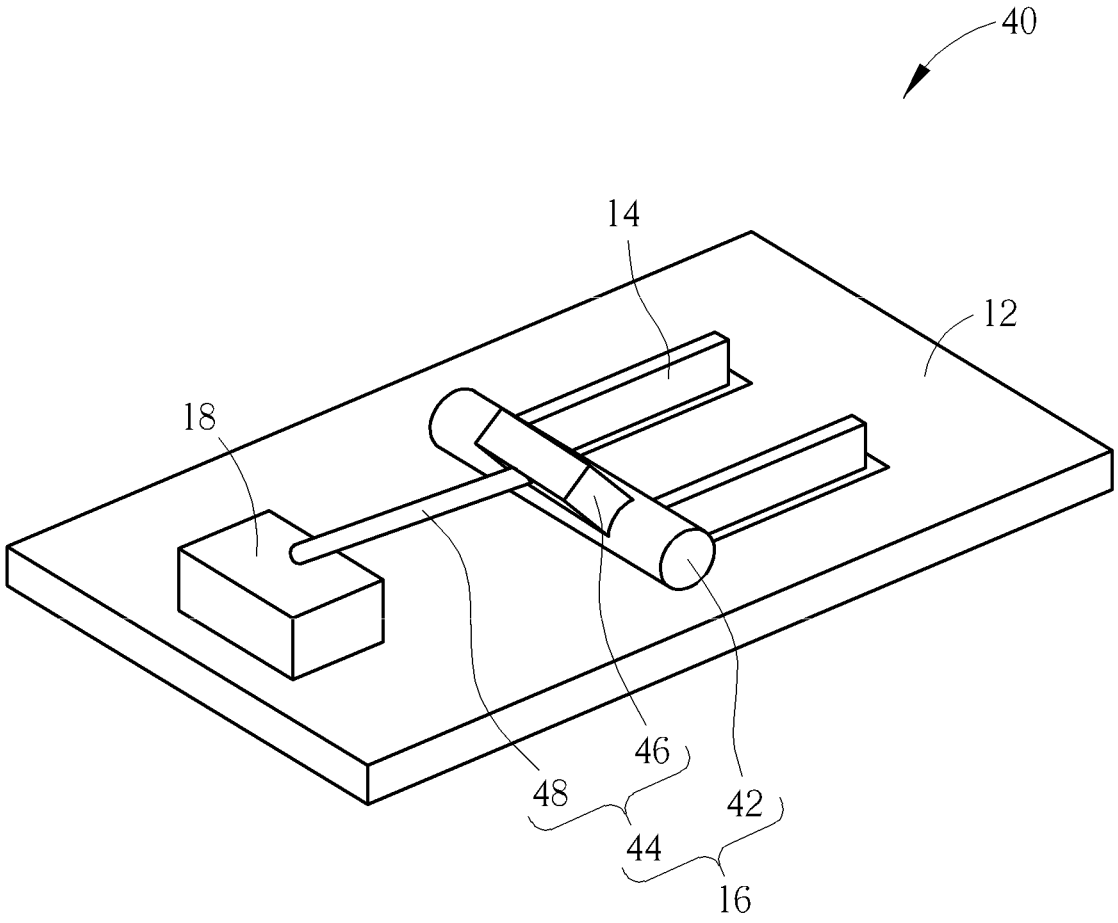
FIG. 8 and FIG. 9 respectively are diagrams of the power adapter in different operation modes according to a third embodiment of the present invention.
Figure 9:
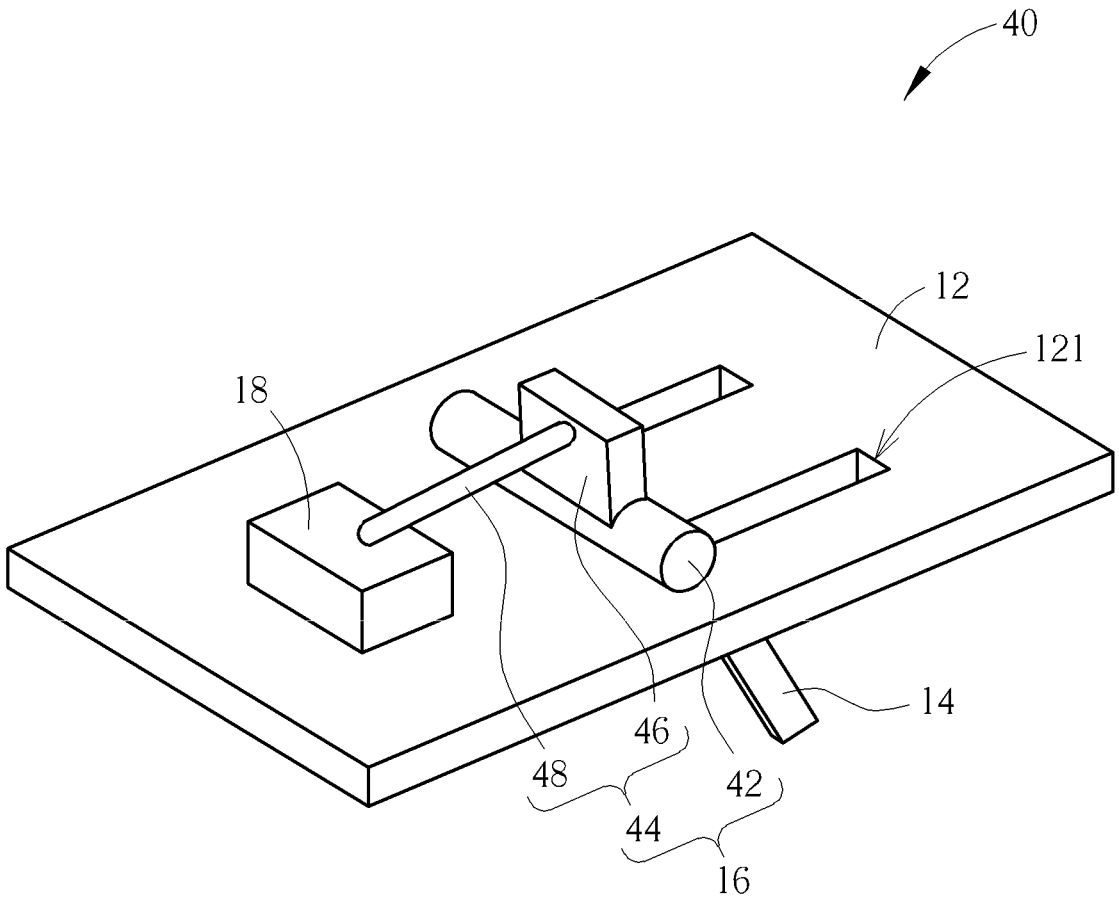

Please refer to FIG. 8 and FIG. 9. FIG. 8 and FIG. 9 respectively are diagrams of the power adapter 40 in different operation modes according to a third embodiment of the present invention. The rotary mechanism 16 further can include a shaft 42 and a linkage set 44. The shaft 42 pivots to the casing 12, and the first connector 14 is disposed on the shaft 42. Two ends of the linkage set 44 are respectively connected to the shaft 42 and the second connector 18. The linkage set 44 can be pressed by the second connector 18 to rotate the shaft 42. The linkage set 44 can include a first bar 46 and a second bar 48. The first bar 46 is disposed on a surface of the shaft 42. The second bar 48 is rotatably connected between the second connector 18 and the first bar 46. For example, universal joints can be disposed on two ends of the second bar 48, and the universal joints can increase rotation fluency of the shaft 42 when the second connector 18 pushes the linkage set 44.

As shown in FIG. 8, the first bar 46 stretches from the surface of the shaft 42 and is slightly inclined toward the second connector 18. At the time, the second connector 18 is not pressed by the external plug 20, and the first connector 14 is accommodated inside the casing 12. As shown in FIG. 9, the second connector 18 moves relative to the bottom of the casing 12 for pressing the linkage set 44 when the external plug 20 inserts into the casing 12 to connect the second connector 18. The second bar 48 of the linkage set 44 can utilize the universal joints to rotate the first bar 46 and the shaft 42, so as to protrude the first connector 14 out of the casing 12. The second bar 48 of the third embodiment not only can be the straight bar shown in FIG. 8 and FIG. 9, but also can be the curved bar with arc structure for specific operation efficiency. Application of the second bar 48 is not limited to the above-mentioned embodiment, and depends on design demand.

Figure 10:
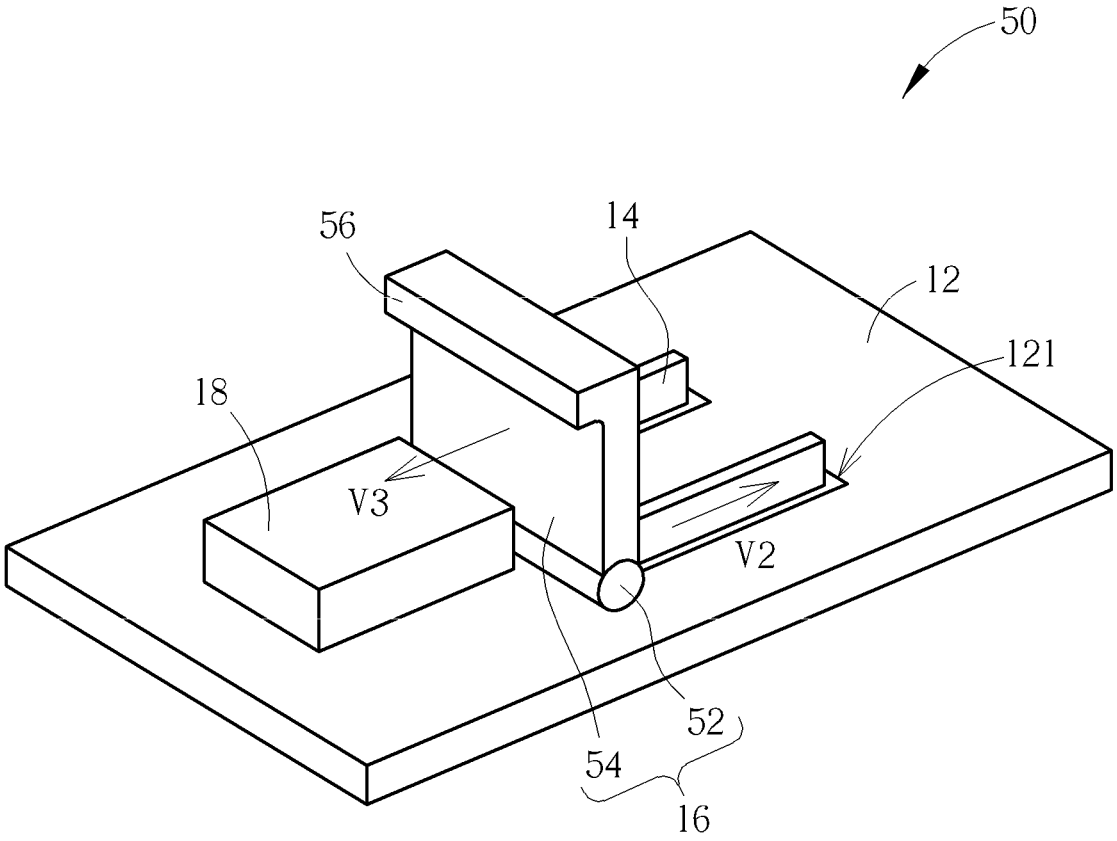
FIG. 10 and FIG. 11 respectively are diagrams of the power adapter in different operation modes according to a fourth embodiment of the present invention.
Figure 11:
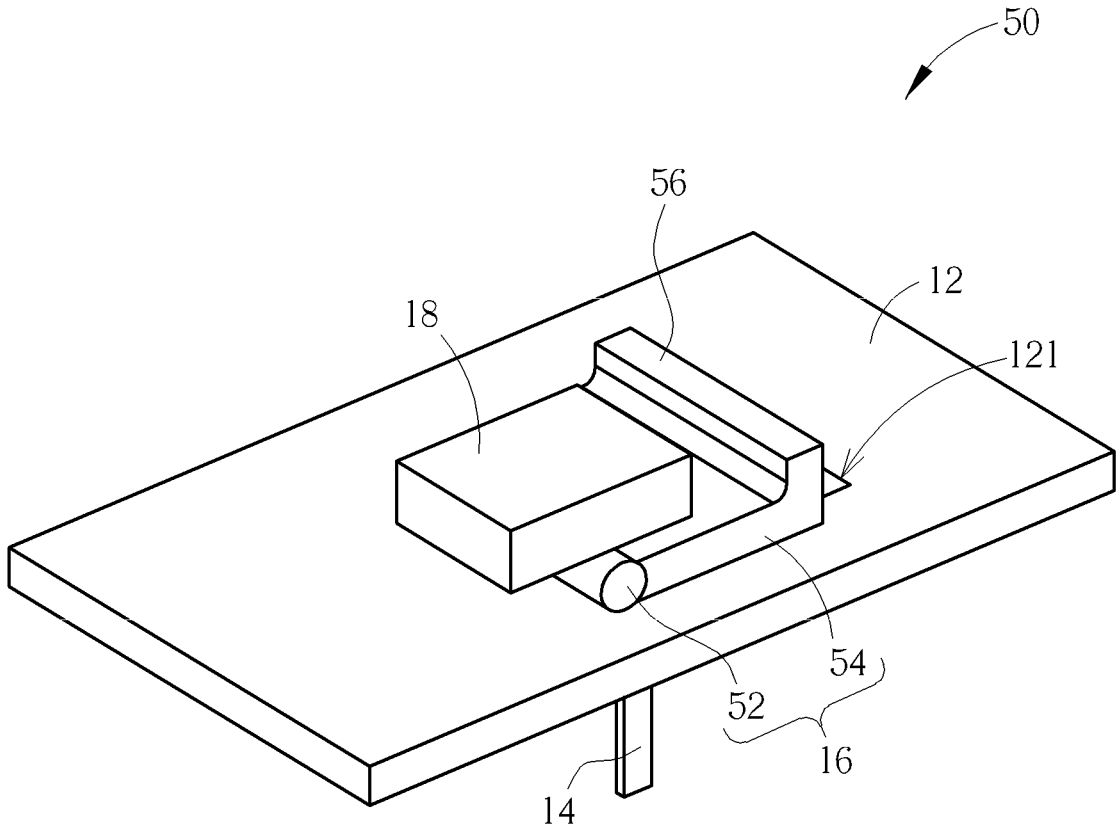

Please refer to FIG. 10 and FIG. 11. FIG. 10 and FIG. 11 respectively are diagrams of the power adapter 50 in different operation modes according to a fourth embodiment of the present invention. The rotary mechanism 16 can further include a shaft 52 and a board 54. The shaft 52 pivots to the casing 12, the first connector 14 and the board 54 are respectively connected to different arc positions of the shaft 52. As shown in FIG. 10, the board 54 is not pressed by the second connector 18, the rotary mechanism 16 keeps the initial state and the first connector 14 is accommodated inside the casing 12.

As shown in FIG. 11, the second connector 18 can move into the casing 12 deeply by the external plug 20, so that second connector 18 can rotate the board 54 and shaft 52 to move the part of the first connector 14 out of the casing 12. A contacting portion 56 can be selectively disposed on an outer edge of the board 54. The contact portion 56 can block the second connector 18 to prevent the second connector 18 from over-slide relative to the board 54. A planer normal vector V3 of the board 54 can be substantially parallel to the structural direction V2 of the first connector 14, so as to ensure that the rotary mechanism 16 can rotate the first connector 14 at 90 degrees to perpendicularly protrude from the casing 12.

Figure 12:
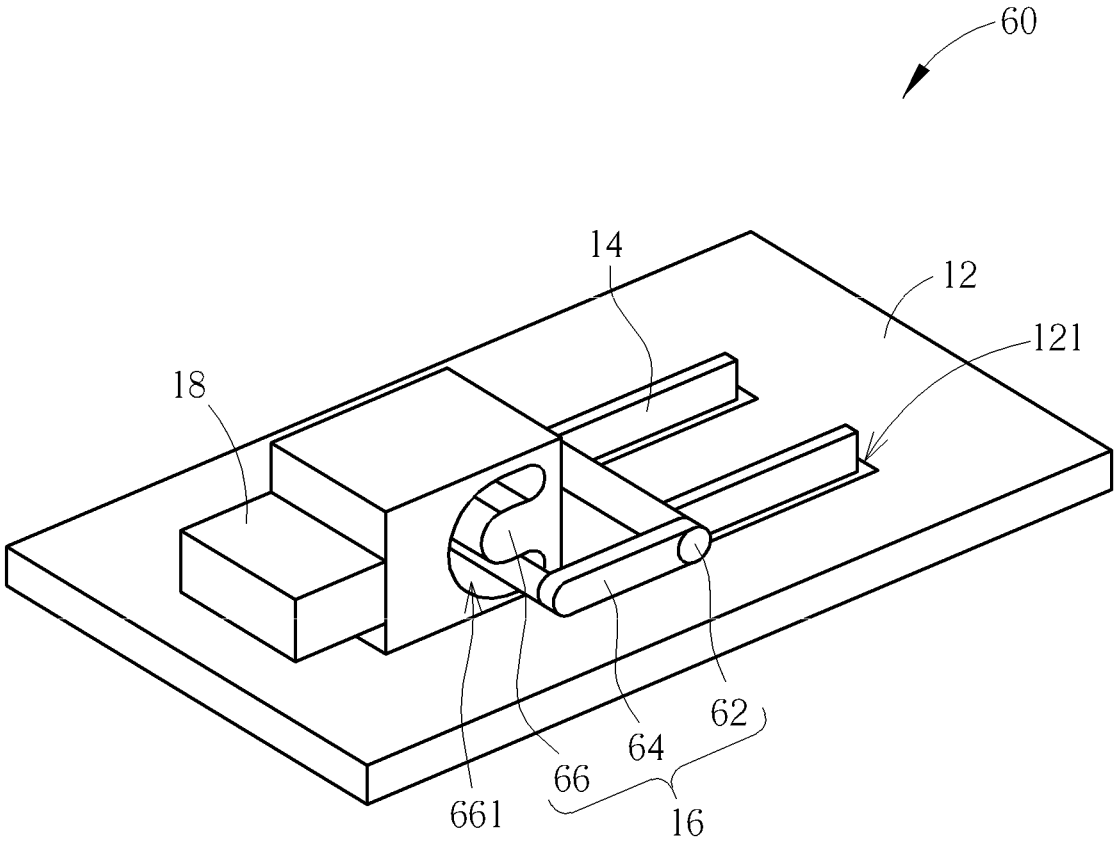
FIG. 12 is a diagram of the power adapter according to a fifth embodiment of the present invention.
Figure 13:
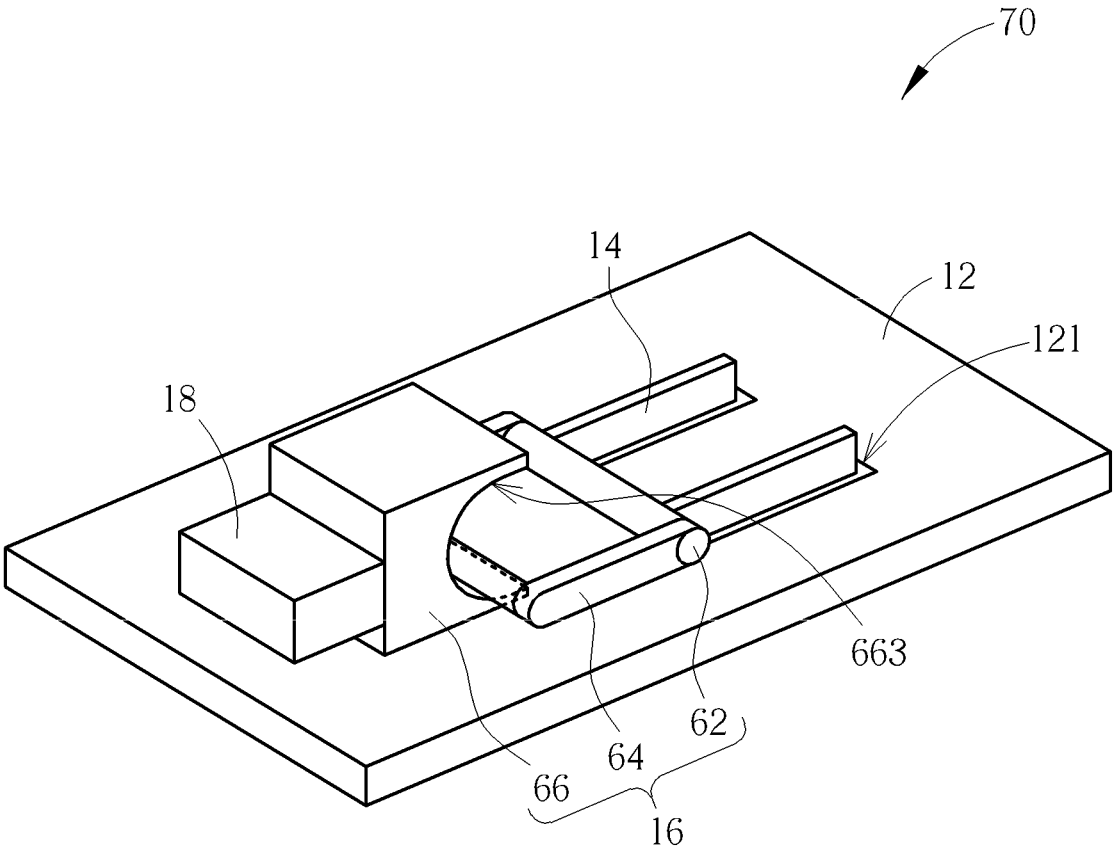
FIG. 13 is a diagram of the power adapter according to a sixth embodiment of the present invention.

Please refer to FIG. 12 and FIG. 13. FIG. 12 is a diagram of the power adapter 60 according to a fifth embodiment of the present invention. FIG. 13 is a diagram of the power adapter 70 according to a sixth embodiment of the present invention. The rotary mechanism 16 can further include a shaft 62, an actuating component 64 and a guiding component 66. The shaft 62 pivots to the casing 12. The actuating component 64 is connected to the shaft 62 and movably disposed inside the guiding component 66.

As shown in FIG. 12, an arc guiding slot 661 is formed on the guiding component 66, and the guiding slot 661 can be the semicircle structure. An end of the actuating component 64 is located at a low end of the guiding slot 661 when the first connector 14 is accommodated inside the casing 12. As the second connector 18 is pressed to move the guiding component 66 close to the shaft 62, the end of the actuating component 64 can slide along the guiding slot 661 from the low end to the upper end, so that the shaft 62 can be revolved to move the first connector 14 partly out of the casing 12.

In the sixth embodiment, elements having the same numeral as ones of the fifth embodiment have the same structures and functions, and detailed description is omitted herein for simplicity. As shown in FIG. 13, the guiding component 66 of the power adapter 70 can further include a guiding arc portion 663. The guiding arc portion 663 can be the semicircle sunken structure. As an end of the actuating component 64 contacts the low edge of the guiding arc portion 663, the first connector 14 is accommodated inside the casing 12. When the second connector 18 is pressed to move the guiding component 66 close to the shaft 62, the end of the actuating component 64 can slide from the low edge to the upper edge of the guiding arc portion 663. The first connector 12 can rotate at 90 degrees by the rotation of the shaft 62 when the end of the actuating component 64 is located at the upper edge of the guiding arc portion 663, and the part of the first connector 12 can protrude from the casing 12 to switch the power adapter from the unused mode to the used mode.

In conclusion, the power adapter of the present invention can automatically eject the first connector from the casing due to connection of the external plug. As the external plug is connected to the second connector of the power adapter, the second connector slidably disposed inside the casing can be pressed by the external plug and generate a slight movement, so as to rotate the rotary mechanism such as the above-mentioned embodiments for protruding the first connector from the casing. After the external plug is removed from the power adapter, the rotary mechanism can recover the first connector and the second connector back to the initial state by the resilient component.

Therefore, the power adapter of the present invention has the automatically adjustable function. Comparing to the prior art, the power adapter of the present invention has advantages of simple structure, low manufacturing cost and easy operation. The power adapter of the present invention can stretch and retract the movable connector automatically according to assembly and disassembly of the external plug, and can effectively overcome the inconveniently operational drawback of the conventional adapter.

Those skilled in the art will readily observe that numerous modifications and alterations of the device and method may be made while retaining the teachings of the invention. Accordingly, the above disclosure should be construed as limited only by the metes and bounds of the appended claims.

What is claimed is:

1. A power adapter comprising:

a casing whereon a first opening and a second opening are formed;

a first connector rotatably disposed on a bottom of the casing;

a rotary mechanism disposed between the casing and the first connector; and a second connector movably disposed inside the casing and connected to the rotary mechanism, the second connector being electrically connected to the first connector, the second connector being pushed by an external plug when the external plug inserts into the second opening to connect the second connector, so as to drive the rotary mechanism to rotate the first connector and to protrude a part of the first connector from the casing via the first opening.

2. The power adapter of claim 1, wherein the first connector is a multi-sheet plug, and the second connector is a universal serial bus socket.

3. The power adapter of claim 1, further comprising:

a resilient component disposed on the rotary mechanism, the resilient component driving the rotary mechanism to rotate the first connector into the casing.

4. The power adapter of claim 1, wherein the rotary mechanism comprises a shaft and an actuating component, the shaft pivots to the casing, the actuating component and the first connector are disposed on the shaft, the second connector is slidably connected to the actuating component.

5. The power adapter of claim 4, wherein an inclined portion is disposed on an end of the actuating component, the second connector slides relative to the inclined portion to rotate the shaft.

6. The power adapter of claim 5, wherein a structural direction of the actuating component is substantially parallel to a structural direction of the first connector, and the inclined portion is a polygon structure.

7. The power adapter of claim 1, wherein the rotary mechanism comprises a gear axle and a rack structure, the gear axle pivots to the casing, the first connector is disposed on the gear axle, the rack structure is engaged with the gear axle and connected to the second connector.

8. The power adapter of claim 7, wherein the second connector pushes the rack structure to revolve the gear axle by engagement.

9. The power adapter of claim 7, wherein a moving distance of the rack structure relative to the gear axle is substantially equal to a one-fourth outer diameter of the gear axle.

10. The power adapter of claim 1, wherein the rotary mechanism comprises a shaft and a linkage set, the shaft pivots to the casing, the first connector is disposed on the shaft, two ends of the linkage set are respectively connected to the shaft and the second connector.

11. The power adapter of claim 10, wherein the linkage set comprises a first bar and a second bar, the first bar is disposed on a surface of the shaft, the second bar is rotatably connected between the second connector and the first bar.

12. The power adapter of claim 11, wherein the second bar is a straight bar or a curved bar.

13. The power adapter of claim 1, wherein the rotary mechanism comprises a shaft and a board, the shaft pivots to the casing, the first connector and the board are respectively disposed on different arc surfaces of the shaft, the second connector pushes the board to rotate the shaft.

14. The power adapter of claim 13, wherein a planar normal vector of the board is substantially parallel to a structural direction of the first connector.

15. The power adapter of claim 1, wherein the rotary mechanism comprises a shaft, an actuating component and a guiding component, the shaft pivots to the casing, the actuating component is connected to the shaft and movably disposed inside the guiding component.

16. The power adapter of claim 15, wherein a guiding slot is formed on the guiding component, and the guiding slot is an arc slot.

17. The power adapter of claim 15, wherein the guiding component comprises a guiding arc portion, and the guiding arc portion is a semicircle sunken structure.

* * * * *